US005606225A

United States Patent [19]

Levine et al.

[11] Patent Number: 5,606,225

[45] Date of Patent: Feb. 25, 1997

[54] TETRODE ARRANGEMENT FOR COLOR FIELD EMISSION FLAT PANEL DISPLAY WITH BARRIER ELECTRODES ON THE ANODE PLATE

[75] Inventors: Jules D. Levine; Bruce E. Gnade, both of Dallas, Tex.

[73] Assignee: Texas Instruments Incorporated, Dallas, Tex.

[21] Appl. No.: 520,810

[22] Filed: Aug. 30, 1995

[51] Int. Cl.[6] ..... H01J 31/15

[52] U.S. Cl. ..... 315/169.3; 315/366; 315/382; 313/497; 313/558

[58] Field of Search ..... 315/169.3, 366, 315/382; 313/309, 336, 351, 461, 466, 467, 481, 495, 496, 497, 553–562

[56] References Cited

U.S. PATENT DOCUMENTS

| | | | |
|---|---|---|---|
| 3,757,704 | 8/1973 | Spindt et al. | 313/309 |
| 4,940,916 | 7/1990 | Borel et al. | 313/306 |
| 4,950,949 | 8/1990 | van der Wilk | 313/495 |
| 5,103,145 | 4/1992 | Doran | 315/381 |
| 5,194,780 | 3/1993 | Meyer | 315/169.3 |
| 5,225,820 | 7/1993 | Clerc | 345/55 |
| 5,231,606 | 7/1993 | Gray | 365/225.6 |
| 5,300,862 | 4/1994 | Parker et al. | 315/169.3 |
| 5,363,021 | 11/1994 | MacDonald | 315/366 |
| 5,378,962 | 1/1995 | Gray et al. | 313/495 |
| 5,453,659 | 9/1995 | Wallace et al. | 313/553 X |

FOREIGN PATENT DOCUMENTS

| | | | |
|---|---|---|---|
| 0635865 | 1/1995 | European Pat. Off. | 313/467 |

*Primary Examiner*—Benny Lee
*Assistant Examiner*—Justin P. Bettendorf
*Attorney, Agent, or Firm*—Christopher L. Maginniss; James C. Kesterson; Richard L. Donaldson

[57] ABSTRACT

An anode plate 40, suitable for use in a field emission display tetrode, includes a transparent planar substrate 42 having thereon a layer 46 of a transparent, electrically conductive material, which comprises the anode electrode of the display tetrode. Barrier structures 48 comprising an electrically insulating, preferably opaque material, are formed on anode electrode 46 as a series of parallel ridges. Atop each barrier structure 48 are a series of electrically conductive stripes 50, which function as deflection electrodes. Luminescent material 52 overlies anode electrode 46 in the channels between barrier structures 48. Conductive stripes 50 are formed into three series such that every third stripe 50 is electrically interconnected. Deflection voltage controller 70 permits selective deflection of electrons toward the proper luminescent material 52. By applying a positive voltage on two of the three series of stripes 50, and applying a negative voltage on the third series of stripes 50, electrons are deflected between pairs of stripes 50 biased to the positive voltage. Deflection electrodes 50 may advantageously be formed of a conductive material having gettering qualities, such as zirconium-vanadium-iron. Also disclosed is a method for fabricating anode plate 40.

28 Claims, 7 Drawing Sheets

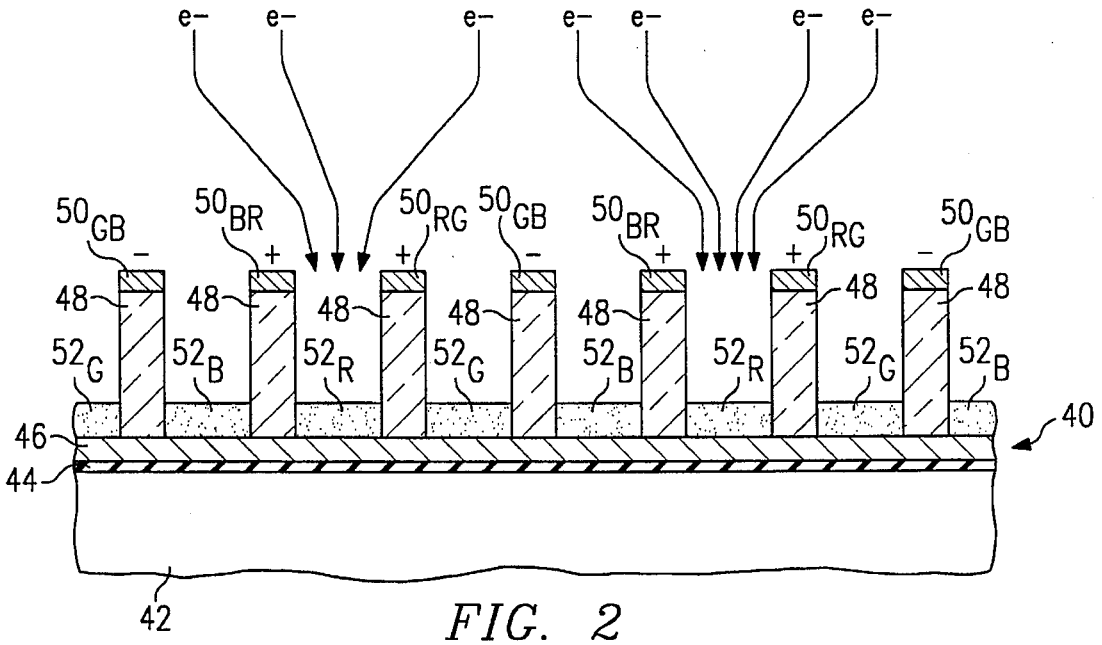
FIG. 2
FIG. 4
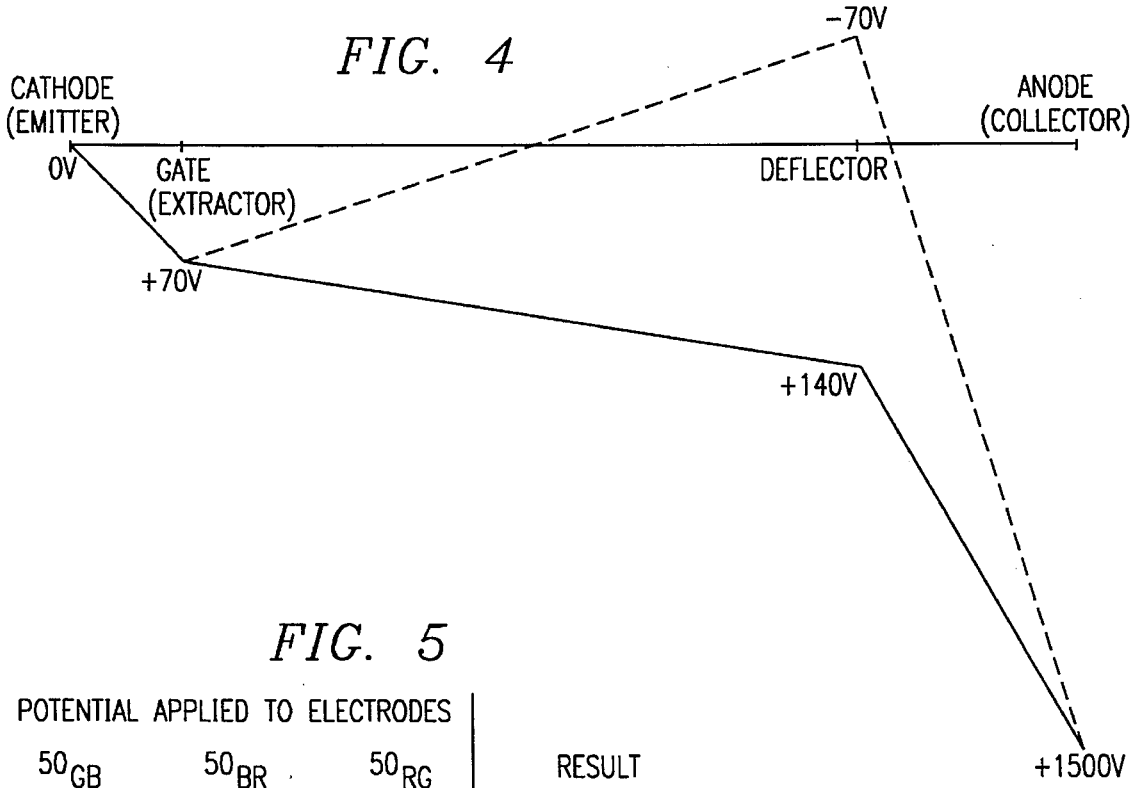
FIG. 5
| POTENTIAL APPLIED TO ELECTRODES | | | |
|---|---|---|---|
| $50_{GB}$ | $50_{BR}$ | $50_{RG}$ | RESULT |
| − | + | + | RED ACTIVATED |
| + | − | + | GREEN ACTIVATED |
| + | + | − | BLUE ACTIVATED |

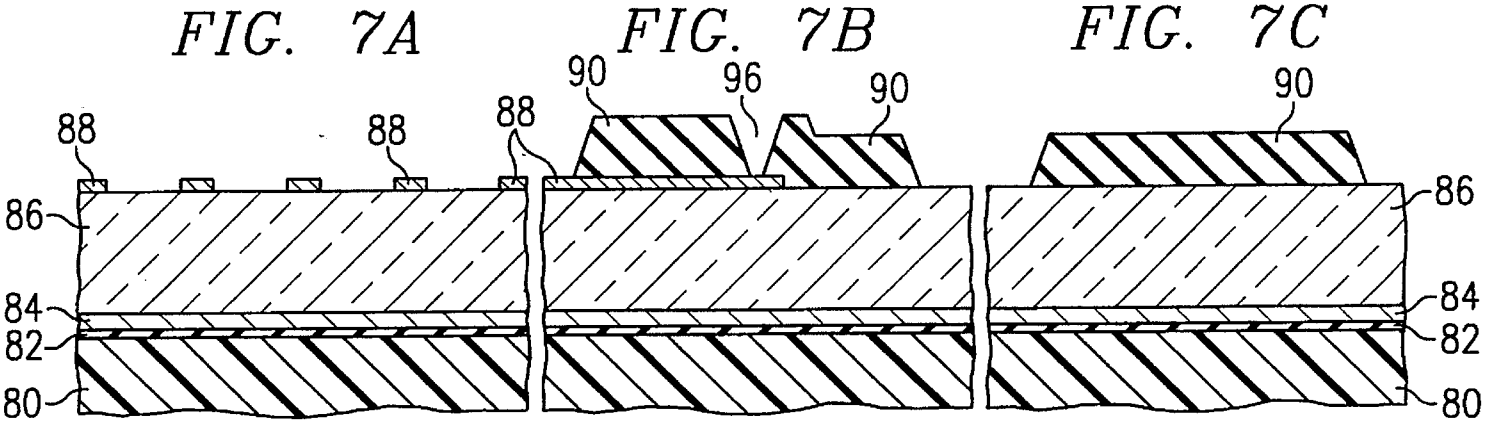
FIG. 7A
FIG. 7B
FIG. 7C
88
90
96
86
84
82
80
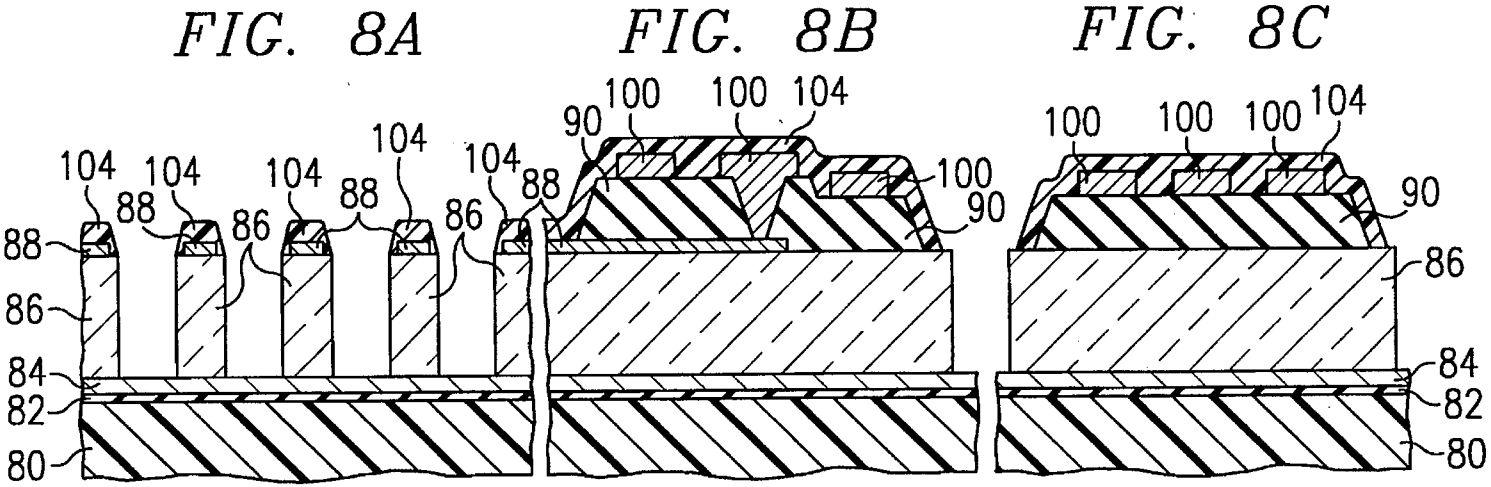
FIG. 8A
FIG. 8B
FIG. 8C
104
88
86
100
90
84
82
80

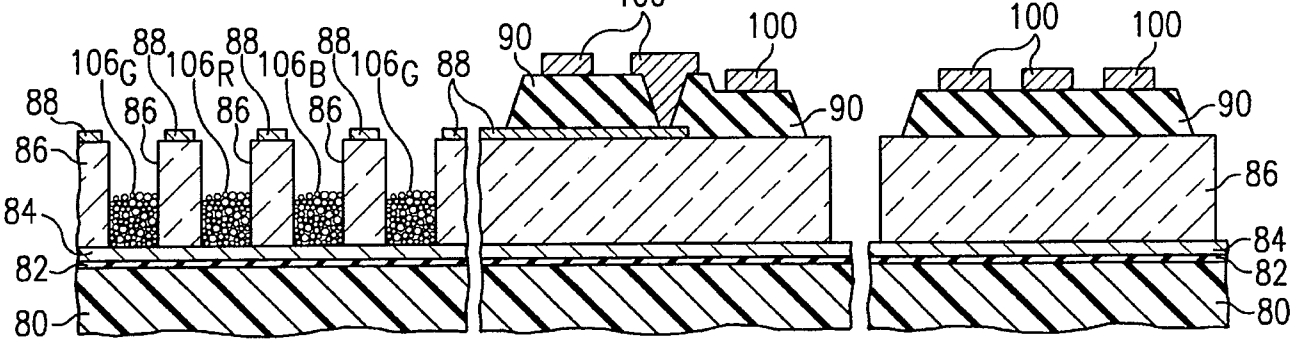
FIG. 9A
FIG. 9B
FIG. 9C
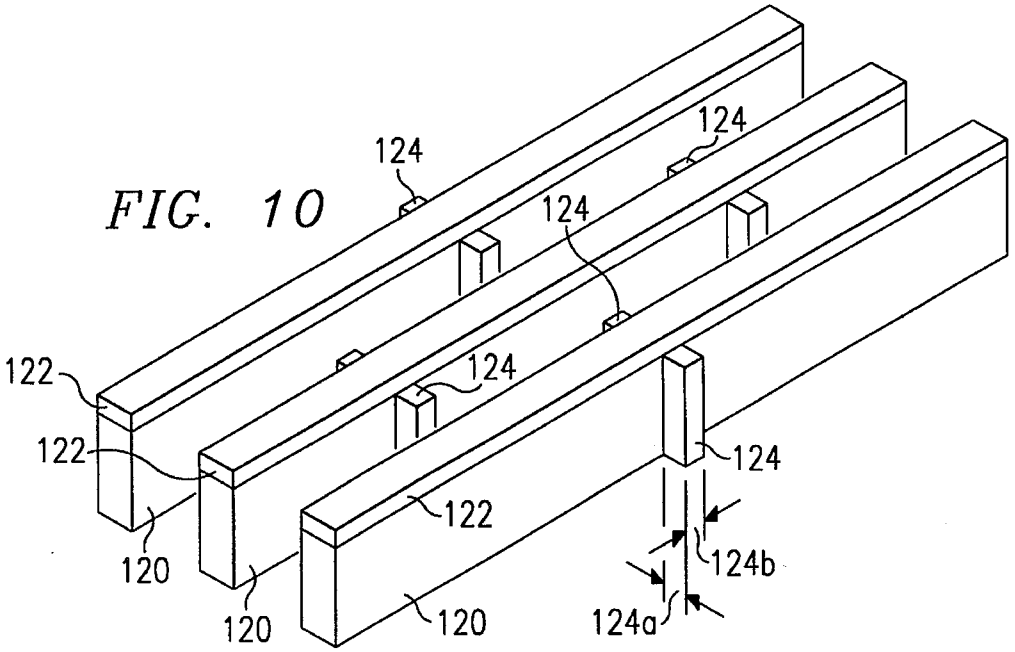
FIG. 10

TETRODE ARRANGEMENT FOR COLOR FIELD EMISSION FLAT PANEL DISPLAY WITH BARRIER ELECTRODES ON THE ANODE PLATE

RELATED APPLICATIONS

U.S. patent application Ser. No. 08/247,951, "Opaque Insulator for Use on Anode Plate of Flat Panel Display," filed 24 May 1994, now U.S. Pat. No. 5,528,102.

U.S. patent application Ser. No. 08/253,476, "Flat Panel Display Anode Plate Having Isolation Grooves," filed 31 May 1994, now U.S. Pat. No. 5,491,376.

U.S. patent application Ser. No. 08/258,803, "Anode Plate for Flat Panel Display Having Integrated Getter," filed 10 June 1994, now U.S. Pat. No. 5,453,659.

U.S. patent application Ser. No. 08/521,510, "Method of Fabricating a Color Field Emission Display Tetrode," filed 30 August 1995.

TECHNICAL FIELD OF THE INVENTION

The present invention relates generally to field emission flat panel displays and, more particularly, to a tetrode arrangement which permits low voltage switching at the anode plate of a field emission flat panel display, and to a method for fabricating such arrangement.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, field emission display technology has been receiving increasing attention by industry. Flat panel displays utilizing such technology employs a matrix-addressable array of pointed, thinfilm, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 August 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 March 1993 to Robert Meyer; and U.S. Pat. No. 5,225,820, "Microtip Trichromatic Fluorescent Screen," issued 6 July 1993, to Jean-Frèdèric Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the gate electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

An example given in the Clerc patent recites voltages on the anode electrodes for attracting emitted electrons in the range of 100–150 volts, with the voltage on the unselected anode electrodes at 40 volts. Recent experimentation, however, has indicated that substantially higher accelerating voltages, in the range of 500–800 volts or even higher, are required to provide a satisfactory display, while the voltage on the unselected anode electrodes must be substantially zero for the desired purity of color.

Since the accelerating voltage on each anode electrode is switched on for a color field (or subflame) period of 5.56 milliseconds in each frame period of 16.67 milliseconds, for an illustrative frame rate of sixty flames per second, the switching losses for a several-hundred-volt swing at that rate are substantial. Where the field emission display device is used in a portable, battery-operated system, such as a notebook computer, large switching losses are incompatible with a desired goal of extended battery life.

It would be desirable to have an anode potential of 1,500 volts, which would allow the use of the inexpensive, high-voltage phosphors of the type in common use among CRT's. U.S. patent application Ser. Nos. 08/247,951, now U.S. Pat. No. 5,5,528,102, and U.S. patent application Ser. No. 08/253,476, now U.S. Pat. No. 5,491,376, have disclosed improved structure which permits the use of higher anode voltages in field emission displays by reducing the possibility of arcing between adjacent anode stripes. However, since switching losses increase with increasing anode potential, the losses associated with switching between 1,500 and zero volts at the above-cited rate make such a scheme unthinkable. It is clear that the concept of anode switching at very high potentials is impractical, and that the arrangement disclosed in the Clerc patent is unusable in a field emission display where the anode voltage is more than a few hundred volts.

In view of the above, it is easily seen that there exists a need for an improved field emission display structure which permits the use of an increased voltage on the anode electrode without an increase in the switching losses accompanying such increased anode voltage.

SUMMARY OF THE INVENTION

In accordance with the principles of the present invention, there is disclosed herein an anode plate for collecting electrons emitted from a source. The anode plate comprises a substrate, a conductive layer on a surface of the substrate, deflection electrodes responsive to applied potentials for directing the electrons to a selected region on the conductive layer, and means tier coupling potentials selectively to the deflection electrodes.

In a preferred embodiment, the deflection electrodes of the anode plate comprise a plurality of conductive stripes, the stripes being positioned atop electrically insulating barrier structures on the conductive layer. The barrier structures form a plurality of substantially parallel, substantially equally-spaced ridges, and the conductive stripes are positioned above the conductive layer at a distance which is at least twice the spacing distance between the barrier structures. Also in a preferred embodiment, the deflection electrodes are advantageously formed from an electrically conductive material having gettering qualities, which may comprise zirconium-vanadium-iron.

Further in accordance with the present invention, there is disclosed herein an electron emission display apparatus which comprises an emitter structure including means tier emitting electrons, and a display panel having a face opposing the emitter structure. The display panel includes a transparent substrate, a transparent, electrically conductive layer on a surface of the substrate, luminescent materials overlying regions of the transparent, electrically conductive layer, and deflection electrodes responsive to potentials applied thereto for deflecting the incident electrons, the deflection electrodes comprising a plurality of conductive stripes positioned atop electrically insulating barrier structures on the conductive layer. The display apparatus also comprises source means for applying potentials to the emitter structure, the display panel conductive layer, and selectively to the deflection electrodes to accelerate electrons emitted by the emitting means toward selected regions of the display panel conductive layer.

BRIEF DESCRIPTION OF THE DRAWING

The foregoing ligatures of the present invention may be more fully understood from the allowing detailed description, read in conjunction with the accompanying drawings, wherein:

FIG. 2 illustrates in cross section an anode plate which forms pan of a field emission display tetrode in accordance with the present invention;

FIG. 4 is a graph illustrating the potentials on the four electrodes of a field emission display tetrode in accordance with the arrangement of FIG. 3;

FIG. 5 is a truth table illustrating the logic rule governing the operation of a field emission display tetrode in accordance with the arrangement of FIG. 3;

FIGS. 7A through 7C illustrate three sections taken through the FIG. 6 embodiment at a first processing stage;

FIGS. 8A through 8C illustrate three sections taken through the FIG. 6 embodiment at a second processing stage;

FIGS. 9A through 9C illustrate three sections taken through the FIG. 6 embodiment after a final processing stage;

FIG. 10 illustrates a variation on the structure of the FIG. 2 embodiment.

DESCRIPTION OF THE PREFERRED EMBODIMENT

Figure 1:
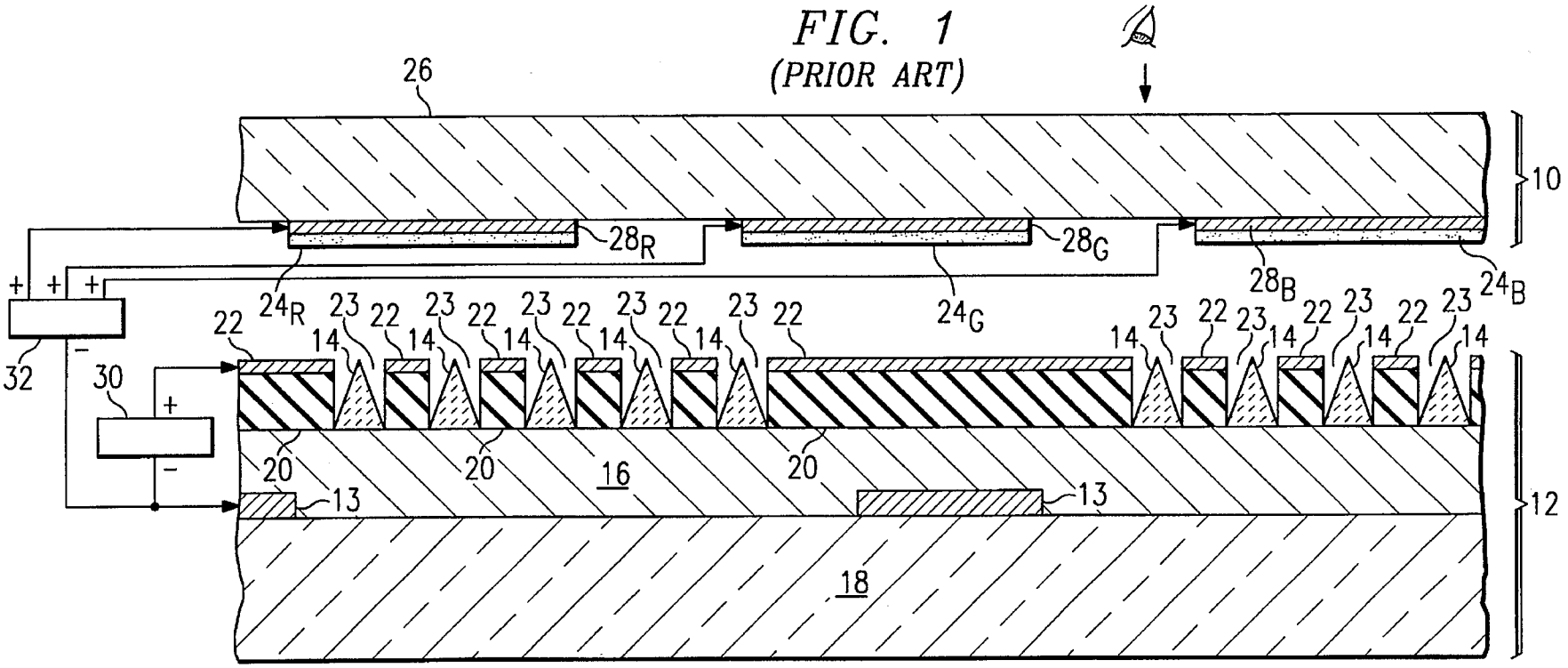
FIG. 1 (PRIOR ART)
FIG. 1 illustrates in cross section a portion of a trichromatic field emission flat panel display device according to the prior art.

Referring initially to FIG. 1, there is shown, in cross-sectional view, a portion of an illustrative, prior art triode field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. (No true scaling information is intended to be conveyed by the relative sizes and positioning of the elements of anode plate 10 and the elements of emitter plate 12 as depicted in FIG. 1.) The cathode electrode portion of emitter plate 12 includes conductors 13 formed on an insulating substrate 18, a resistive layer 16 also formed on substrate 18 overlying conductors 13, and a multiplicity of electrically conductive microtips 14 formed on resistive layer 16. In this example, conductors 13 comprise a mesh structure, and microtip emitters 14 are configured as an array within the mesh spacings, as taught in U.S. Pat. No. 5,194,780, "Electron Source with Microtip Emissive Cathodes," issued 16 March 1993 to Robert Meyer.

A gate electrode comprises a layer of an electrically conductive material 22 which is deposited on an insulating layer 20 overlying resistive layer 16. Microtip emitters 14 are in the shape of cones which are formed within apertures 23 through conductive layer 22 and insulating layer 20. The thicknesses of gate electrode layer 22 and insulating layer 20 are chosen in conjunction with the size of apertures 23 so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material $\mathbf{28}_R$, $\mathbf{28}_G$ and $\mathbf{28}_B$ referred to collectively as conductors 28, deposited on a transparent planar support 26, which is positioned facing gate electrode 22 and parallel thereto, the conductors 28 being deposited on the surface of support 26 directly facing gate electrode 22. In this example, the regions of conductors 28, which comprise the anode electrode, are in the form of electrically isolated stripes comprising three series of parallel conductive bands across the surface of support 26, as taught in the Clerc ('820) patent. Anode plate 10 also comprises cathodoluminescent phosphor coatings $24_R$, $24_G$ and $24_B$, deposited, respectively, over conductive regions $28_R$, $28_G$ and $28_B$, so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward a selected conductive region $28_R$, $28_G$ and $28_B$, on anode plate 10, which region is selectively positively biased by the application of a substantially larger positive voltage from voltage supply 32 coupled to the three conductive regions $28_R$, $28_G$ and $28_B$, functioning as anode electrodes. Energy from the electrons attracted to the anode conductor $28_R$, $28_G$ or $28_B$, is transferred to the corresponding phosphor coating $24_R$, $24_G$ and $24_B$, resulting in luminescence. The electron charge is transferred from phosphor coating $24_R$, $24_G$ and $24_B$, to conductive region $28_R$, $28_G$ and $28_B$, completing the electrical circuit to voltage supply 32.

Referring now to FIG. 2, there is shown, in cross-sectional view, an anode plate 40 which forms part of a field emission display tetrode in accordance with the present invention, which is an improvement over the prior art triode arrangement shown in FIG. 1. Anode plate 40 comprises a transparent planar substrate 42 having, optionally, a layer 44 of an insulating material, illustratively silicon dioxide ($SiO_2$). A layer 46 of a transparent, electrically conductive material overlies insulating layer 44. Conductive layer 46 comprises the anode electrode of the field emission flat panel display tetrode of the present invention. Barrier structures 48 comprising an electrically insulating, preferably opaque material, are formed on anode electrode 46 as a series of parallel ridges. Atop each barrier structure 48 is an electrically conductive layer $50_{GB}$, $50_{BR}$, $50_{RG}$, $50_{GBG}$, . . . ,referred to collectively as deflection electrodes 50. Luminescent material $52_G$, $52_B$ and $52_R$, referred to collectively as luminescent material 52, overlies anode electrode 46 in the channels between barrier structures 48, such that material $52_B$, luminescing in the blue, is between barriers 48 which are topped by conductors $50_{GB}$ and $50_{BR}$, material $52_R$, luminescing in the red, is between barriers 48 which are topped by conductors $50_{BR}$ and $50_{RG}$, and material $52_G$, luminescing in the green, is between barriers 48 which are topped by conductors $50_{RG}$ and $50_{GB}$. For purposes of this disclosure, as well as in the claims which follow, the term "transparent" shall refer to a high degree of optical transmissivity in the visible range, i.e., in the region of the electromagnetic spectrum between approximately 400–800 nanometers. Furthermore, the term "opaque" shall refer to a low degree of optical transmissivity in the visible range.

In the present example, substrate 42 comprises glass. Also in this example, conductive layer 46 comprises a material such as indium-tin-oxide (ITO), which is optically transparent and electrically conductive. Further in this example, luminescent material 52 comprises a particulate phosphor coating which luminesces in one of the three primary colors, red ($52_R$), green ($52_G$) and blue ($52_B$). The conductive material which comprises deflection electrodes 50 may be any type of conductor; however, as will be disclosed later in relation to FIG. 11, deflection electrodes 50 may advantageously be formed of a conductive material having gettering qualities, such as zirconium-vanadium-iron.

The substantially opaque, electrically insulating material which forms barriers 48 preferably comprises glass having impurities dispersed therein, wherein the impurities may include one or more organic dyes, the combination of dyes being selected to provide relatively uniform opacity over the visible range of the electromagnetic spectrum. Alternatively, the impurities may include an oxide of a transition metal, the transition metal being chosen from among those which form black oxides. In the latter case, the metallic oxide particles must be sufficiently dispersed within the glass such that barriers 48 retain a high degree of electrical insulating quality. This insulating material may be of the type taught in U.S. patent application Ser. No. 08/247,951, now U.S. Pat. No. 5,528,102, cited above, to form a black matrix on the display face and thereby reduce reflections. Alternatively, the insulating material of barriers 48 may comprise dielectric stacks of alternating layers of $Cr_2O_3$/Cr and Si/$SiO_2$, which can provide a high degree of opacity with reasonable dielectric properties. These layers are sold by, for example, OCLI, of Santa Barbara, Calif.

By way of illustration, the width of the channels between adjacent barriers 48, i.e., the width of the phosphor stripe 52, may be 70 microns, and barriers 48 may be 30 microns in width. Further by way of illustration, the thickness of conductor 46 may be approximately 150 nanometers, and the thickness of phosphor coatings 52 may be approximately 15 microns.

Figure 3:
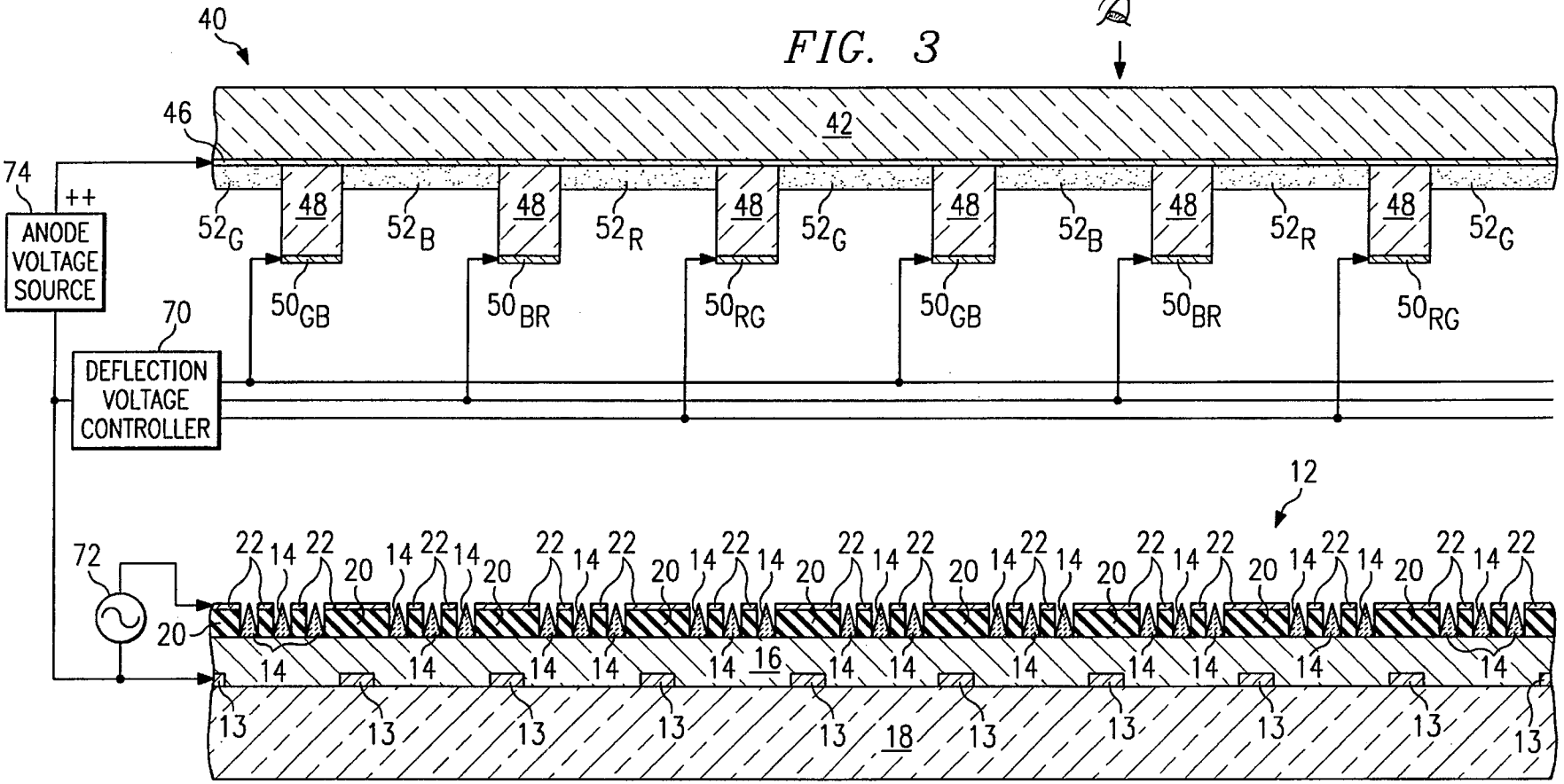
FIG. 3 illustrates diagrammatically and in cross section a tetrode arrangement of a field emission display device in accordance with the present invention.

FIG. 3 illustrates diagrammatically and in cross section a tetrode arrangement of a field emission display device in accordance with the present invention. The display device comprises an emitter plate 12, similar to the emitter plate of the prior art (see FIG. 1). The cathode electrode includes conductors 13 formed as a mesh structure on an insulating substrate 18, a resistive layer 16 also formed on substrate 18 overlying conductors 13, and a multiplicity of electrically conductive microtips 14 formed on resistive layer 16. The gate electrode comprises a layer of an electrically conductive material 22 which is deposited on an insulating layer 20 overlying resistive layer 16. Microtip emitters 14 are formed within apertures through conductive layer 22 and insulating layer 20. Source 72, coupled between gate layer 22 and mesh structure conductors 13, provides an electrical signal between the gate and cathode electrodes, stimulating emission of electrons from microtips 14 when gate electrode 22 is biased to about 70 volts above cathode electrode 13.

The display device further comprises an anode plate 40, similar to the embodiment shown in FIG. 2. Transparent planar substrate 42 is overlain by a layer 46 of a transparent, electrically conductive material, comprising the anode electrode of the field emission flat panel display tetrode of the present invention. Source 74, coupled between conductive layer 46 and mesh structure conductors 13, provides a steady dc accelerating potential to the anode electrode, illustratively on the order of 1500 volts.

Barrier structures 48 comprising an electrically insulating material are form as a series of parallel ridges, having a series of stripes $50_{GB}$, $50_{BR}$, $50_{RG}$, $50_{GB}$, . . . of an electrically conductive material, on top of each barrier 48. Luminescent material $52_G$, $52_B$ and $52_{BR}$, lies in the channels between barrier structures 48, such that material $52_B$, luminescing in the blue, is between barriers 48 which are topped by conductive stripes $\mathbf{50}_{GB}$ and $\mathbf{50}_{BR}$, material $\mathbf{52}_{R}$, luminescing in the red, is between barriers 48 which are topped by conductive stripes $\mathbf{50}_{BR}$ and $\mathbf{50}_{RG}$, and material $\mathbf{52}_{G}$, luminescing in the green, is between barriers 48 which are topped by conductive stripes $\mathbf{50}_{RG}$, and $\mathbf{50}_{GB}$. The individual conductive stripes $\mathbf{50}_{GB}$, $\mathbf{50}_{BR}$, and $\mathbf{50}_{RG}$ are coupled (not shown) such that all $\mathbf{50}_{BG}$ stripes are electrically interconnected, all $\mathbf{50}_{BR}$ stripes are electrically interconnected, and all $\mathbf{50}_{RG}$ stripes are electrically interconnected.

Deflection voltage controller 70, coupled between conductive stripes 50 and mesh structure conductors 13 permits selective deflection of the electrons emitted by 15 microtips 14 toward the proper luminescent material 52. By applying a positive voltage, illustratively +140 volts, on two of the three series of stripes 50, and applying a negative voltage, illustratively −70 volts, on the third series of stripes 50, the electrons are deflected between pairs of stripes 50 biased to the positive voltage. Controller 70 switches the positive and negative voltages sequentially to the series of stripes 50, enabling color switching of the display device.

FIG. 4 is a graph illustrating the potentials on the four electrodes of a field emission display tetrode in accordance with the arrangement of FIG. 3. Electrons are extracted by the gate electrode from the emitters when the gate is biased to approximately +70 volts with respect to the cathode. The freed electrons are accelerated toward the anode, biased at approximately +1500 volts. Where a pair of adjacent deflection electrodes are biased to a positive potential, illustratively +140 volts, the electrons are steered in their direction, accelerating toward the anode electrode between these positively biased deflection electrodes. However, where the deflection electrodes are biased to a negative potential, illustratively −70 volts, a potential wall is established which repels the electrons. FIG. 2 illustrates the deflection of electrons $e^-$ through the adjacent pairs of positively biased deflection electrodes $\mathbf{50}_{B}$ and $\mathbf{50}_{RG}$, and toward the selected red phosphor $\mathbf{52}_{R}$.

FIG. 5 is a truth table illustrating the logic rule governing the operation of a field emission display tetrode in accordance with the arrangement of FIG. 3. In practice, it is deemed preferable that deflection electrodes 50 will reside normally at the more positive voltage, e.g. , +140 volts, and will be sequentially switched to the more negative voltage, e.g., −70 volts.

Figure 6:
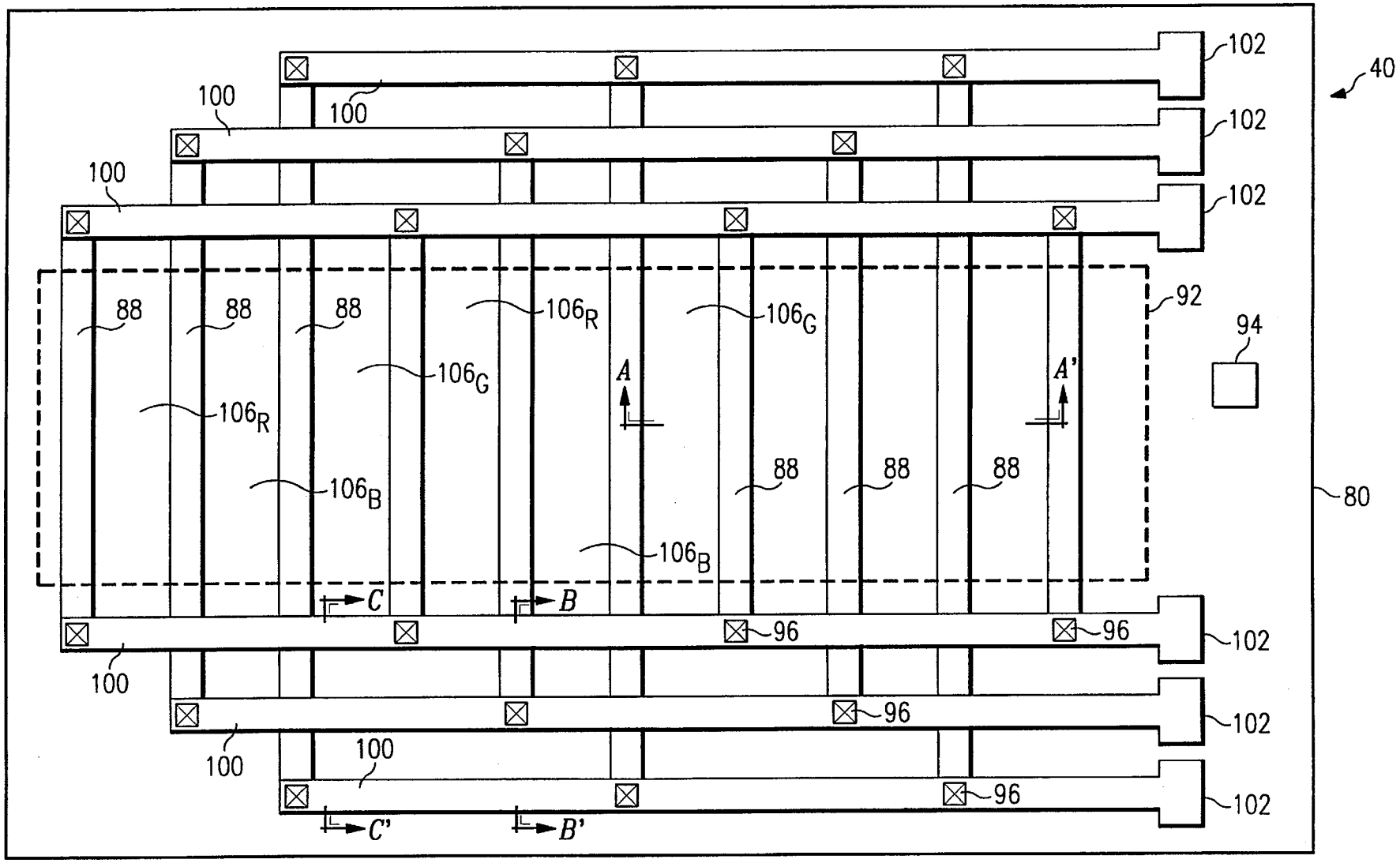
FIG. 6 illustrates in plan view an anode in accordance with FIG. 2.

FIG. 6 illustrates in plan view an anode plate 40 in accordance with FIG. 2. This view, in conjunction with sections along lines A-A', B-B' and C-C', and shown in FIGS. 7A through 7C, 8A through 8C and 9A through 9C, is helpful in understanding a preferred method for fabricating anode plate 40 of the present invention.

In accordance with this preferred method, a transparent substrate 80 is provided; substrate 80 may typically comprise a sheet of soda lime glass, 1.1 millimeter (mm) in thickness. Substrate 80 is optionally coated with an insulating layer 82, typically $SiO_2$, which may be sputter deposited to a thickness of approximately 50 nanometers (nm). A layer 84 of a transparent, electrically conductive material, typically indium-tin-oxide (ITO), is deposited on layer 82, illustratively by sputtering to a thickness of approximately 150 nm.

An insulating layer 86 of high vacuum compatible material, such as spin-on-glass (SOG) is deposited over ITO layer 84. The final height of layer 86 should preferably be at least twice the width of the phosphor stripe 52 (see FIG. 2). For instance, a phosphor stripe 52 having a width of 70 microns would require an insulating layer 86 height of 140 microns. However, it may be found that the height required of barrier 48 (FIG. 2) may be voltage dependent; in such case, for an anode voltage less than the voltage cited here by way of illustration, a lesser height of insulating layer may be acceptable.

A layer of a conductive material is deposited on insulating layer 86. This conductive layer will be used not only as the deflection electrodes 50 (see FIG. 2) for lensing emitted electrons toward the proper phosphor stripes 52, but may also serve to getter residual atmospheric molecules within the evacuated display. Since the advantageous gettering qualities of conductors 50 (see FIG. 2) are an important feature of this disclosure, this conductive layer will be referred to as the "getter layer," and the stripes patterned therefrom as "getter stripes 88", for the balance of the description of this fabrication process. Nevertheless, it will be understood that this conductive layer may also comprise typical conductors such as copper, aluminum, silver, gold, etc.—materials not recognized from gettering qualities.

A first. resist layer (not shown) is patterned on the getter layer using standard photolithography techniques to define the getter stripes 88 that will be interconnected to create three comb-like structures. The getter layer is etched using an etch technology that assures high selectivity to insulating layer 86, which is used at this process step as an etch stop. The remainder of the first resist layer is removed after the etch of the getter layer using techniques that do not affect the surface properties of the getter metal.

A second insulating layer, referred to as getter bus insulator 90, is deposited over insulating layer 86 and getter stripes 88. Insulator 90 serves to insulate the material of getter stripes 88 from subsequent layers. Getter bus insulator 90 must have high selectivity under plasma each to both the getter metal of stripes 88 and insulating layer 86. Silicon nitride ($Si_3N_4$) is suggested as a possible material for getter bus insulator 90, with a thickness sufficient to assure proper electrical insulation and to minimize capacitive coupling between stripes 88 and subsequent conductive layers.

A second resist layer (not shown) is patterned on getter bus insulator layer 90 using standard photolithography techniques to define the active anode region 92 and a conduction pad 94 (see FIG. 6) which provides contact to ITO layer 84, which functions as the anode electrode. This pattern will also contain the via locations 96 within the comb connection regions.

Getter bus insulator 90 is then etched using an etch technology that assures high selectivity with respect to both the material of stripes 88 and insulating layer 86. The remainder of the second resist layer is removed using a technique that does not affect the surface properties of the getter metal. FIGS. 7A, 7B and 7C illustrate three sections taken, respectively, along section lines A-A', B-B' and C-C' of the FIG. 6 embodiment at the present stage in the process of the present example.

A conductive layer, referred to as the getter bus connector layer, is then deposited over insulating layer 86, getter stripes 88 and getter bus insulator 90. The material of the getter bus connector layer must have the property of making ohmic contact to the getter metal of stripes 88 through the getter bus insulator vias 96 formed in the previous step.

A third resist layer (not shown) is patterned on the getter bus connector layer using standard photolithography techniques to define six getter bus leads 100. Three such getter bus leads 100 are on each end of the array of getter metal stripes 88, each one connecting to every third getter metal stripe 88 through the getter bus insulator vias 96 to form three interlineate comb structures. Each getter bus lead 100 terminates in a bond pad 102 (see FIG. 6) on top of getter bus insulator 90, bond pads 102 being sufficiently large for making all external connections to the combs. There is one getter bus lead 100 for each comb at each end of the array of getter metal stripes 88.

The getter bus connector layer is then etched, using an etch technique that is highly selective to getter bus insulator 90, the metal of getter stripes 88 and insulating layer 86. The remainder of the third resist layer is removed using a technique that does not affect the surface properties of the getter metal.

A sacrificial layer 104 is then deposited, fully covering the entire surface of the assembly. Sacrificial layer 104 must have the following properties: (a) it must not be etched by the insulating layer 86 etch chemistry; (b) its etchant must not attack insulating layer 86 or the metal of getter stripes 88; and (c) it must not destroy the surface properties of the getter metal.

A fourth resist layer (not shown) is patterned on sacrificial layer 104 using standard photolithography techniques to define an area oversized to the broad area getter bus insulator 90 pattern, with no vias. The pattern will also cover getter stripes 88, the pattern extending beyond getter stripes 88 on each side, illustratively by 3 microns. This pattern also opens the fourth resist layer to define ITO layer conduction pad 94 (see FIG. 6). Sacrificial layer 104 is then etched in an etchant which is highly selective to insulating layer 86 and the metal of getter stripes 88. The remainder of the fourth resist layer is removed using a technique that does not affect the surface properties of the getter metal.

Insulating layer 86 is then etched using an etch technique which is anisotropic so as to create vertical sidewalls with no undercut, and without attacking the material of sacrificial layer 104, which acts as an etch mask. Insulating layer 86 is etched to completion against ITO layer 84, which acts as an etch stop; the etchant in this step must therefore be highly selective to ITO. FIGS. 8A, 8B and 8C illustrate three sections taken, respectively, along section lines A-A', B-B' and C-C' of the FIG. 6 embodiment at the present stage in the process of the present example.

Sacrificial layer 104 is then blanket stripped using an etchant which is highly selective to ITO layer 84, the metal of getter stripes 88, insulating layer 86, getter bus insulator 90 and the getter bus connector metal formed as getter bus leads 100. Getter metal surface properties must not be affected by the strip of sacrificial layer 104. The surface of ITO layer 84 must be left in such a state that electrical contact during subsequent phosphor deposition and external bonding are both possible.

The luminescent materials, i.e. , phosphors $\mathbf{106}_R$, $\mathbf{106}_G$, and $\mathbf{106}_B$ are then deposited, typically by electrophoretic deposition. This is accomplished by placing the anode assembly in a solution including phosphor ions and biasing ITO layer 84 to a strong positive bias. Pairs of combs (comprising two sets of getter stripes 88 and their corresponding left and right getter bus leads 100) are positively biased, with the third comb negatively biased in order to deselect the two regions of exposed ITO layer 84 that will have negatively ionized phosphors gated away. The electrophoretic process is repeated twice more using phosphors of a different color each time, and applying a positive bias to different pairs of combs each time, and a negative bias to the remaining comb. Thus, phosphors $\mathbf{106}_R$, $\mathbf{106}_G$ and $\mathbf{106}_B$ are deposited using the same biasing technique that is used to guide the electrons to the proper color lines during display usage (see the logic rule governing electron deflection illustrated in FIG. 5). Alternatively, phosphors $\mathbf{106}_R$, $\mathbf{106}_G$, and $\mathbf{106}_B$ may be deposited by a slurry technique, where the phosphor is patterned photolithographically, developed and etched, using known techniques. The slurry process is repeated twice more, using phosphors of a different color each time. FIGS. 9A, 9B and 9C illustrate three sections taken, respectively, along section lines A-A', B-B', and C-C' of the FIG. 6 embodiment at this final stage in the process of the present example.

FIG. 10 illustrates a variation of the structure of the FIG. 2 embodiment. In this arrangement, barriers 120 include a plurality of side support members (or "wings") 124 which provide lateral support for the relatively tall barriers 120 of the present invention. Wings 124 are not covered by deflection electrode conductors 122. Since wings 124 extend into the phosphor regions of the anode, their length, shown as dimension 124*a*, which contributes principally to the support function, should be as long as possible without creating a line resolvable to the human eye in the worst case, illustratively 45 microns. The width of wings 124, shown as dimension 124*b*, should be at least equal to the width of barrier 120, but small enough not to be resolvable by the human eye, illustratively 30 microns. Wings 124 are formed during the patterning of sacrificial layer 104 and the subsequent etch through insulating layer 86 (see FIG. 8A).

Figure 11:
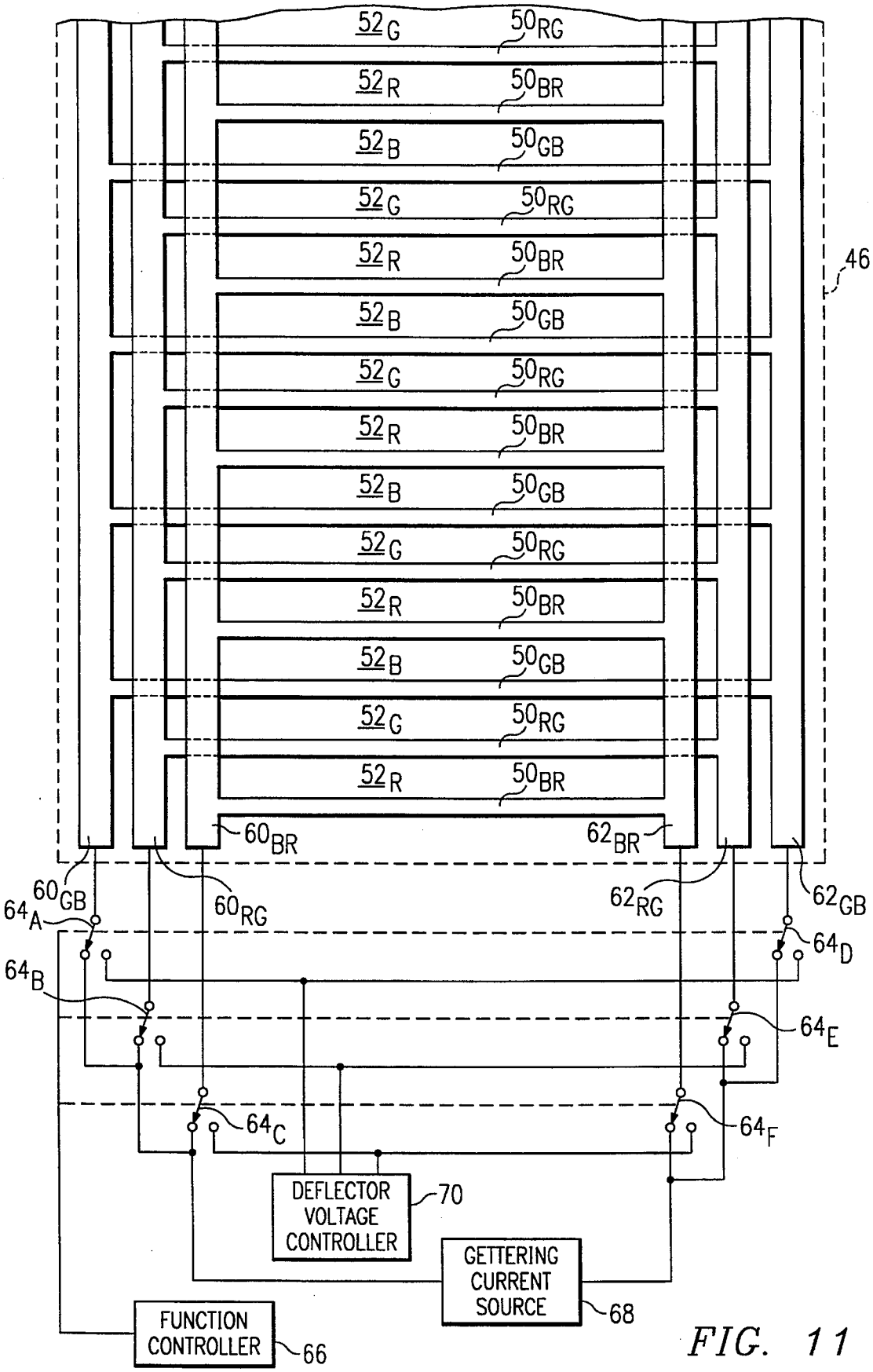
FIG. 11 is a simplified circuit diagram which illustrates use of the FIG. 2 device selectively as a deflector electrode and as a thermally activated getter.

FIG. 11 is a simplified circuit diagram which illustrates use of the FIG. 2 device selectively as a deflector electrode and as a thermally activated getter. Anode electrode 46, comprising a transparent, electrically conductive material, overlies an insulating substrate (not shown). Conductors $\mathbf{50}_{GB}$, $\mathbf{50}_{BR}$, $\mathbf{50}_{RG}$, $\mathbf{50}_{GB}$, . . ., referred to collectively as deflection electrode stripes 50, sit atop barrier structures 48 (see FIG. 2), and extend in parallel relation to one another across the entire display region of anode electrode 46. Luminescent material $\mathbf{52}_G$, $\mathbf{52}_B$ and $\mathbf{52}_R$, referred to collectively as luminescent material 52, overlies anode electrode 46 in the spaces between deflection electrode stripes 50, such that material $\mathbf{52}_B$, luminescing in the blue, is between deflection electrodes $\mathbf{50}_{GB}$ and $\mathbf{50}_{BR}$, material $\mathbf{52}_R$, luminescing in the red, is between deflection electrodes $\mathbf{50}_{BR}$ and $\mathbf{50}_{RG}$, and material $\mathbf{52}_G$, luminescing in the green, is between deflection electrodes $\mathbf{50}_{RG}$ and $\mathbf{50}_{GB}$.

Deflection electrodes $\mathbf{50}_{GB}$ are electrically coupled at their left extremities by bus structure $\mathbf{60}_{GB}$, deflection electrodes $\mathbf{50}_{RG}$ are electrically coupled at their left extremities by bus structure $\mathbf{60}_{RG}$; and deflection electrodes $\mathbf{50}_{BR}$ are electrically coupled at their left extremities by bus structure $\mathbf{60}_{BR}$. Similarly, deflection electrodes $\mathbf{50}_{GB}$ are electrically coupled at their right extremities by bus structure $\mathbf{60}_{GB}$, deflection electrodes $\mathbf{50}_{RG}$ are electrically coupled at their right extremities by bus structure $\mathbf{60}_{RG}$, and deflection electrodes $\mathbf{50}_{BR}$ are electrically coupled at their right extremities by bus structure $\mathbf{60}_{BR}$.

In this example, deflection electrode stripes 50 are made of a conductive material having gettering qualities, such as zirconium-vanadium-iron (ZrVFe), which serves to continually adsorb the gases which are released within or which seep into the evacuated display, as taught in U.S. patent application Ser. No. 08/258,803, now U.S. Pat. No. 5,453,659, cited above. Where deflection electrodes are intended to function as a getter, they will require an initial activation process of elevating the temperature of the getter material to approximately 300° C. while the display is being assembled under high vacuum conditions.

Switching devices $\mathbf{64}_A$, $\mathbf{64}_B$, $\mathbf{64}_C$, $\mathbf{64}_D$, $\mathbf{64}_E$ and $\mathbf{64}_F$, referred to collectively as switches 64, are coupled, respectively, at their common terminals to bus structures $60_{GB}$, $60_{RG}$, $60_{BR}$, $626_{GB}$, $62_{RG}$ and $62_{BR}$. Function controller 66 determines the configuration of switches 64. In a first such configuration, deflection electrodes 50 are coupled to a deflection voltage controller 70, which illustratively applies potentials to deflection electrodes 50 in accordance with the scheme shown in FIG. 5 and described in the accompanying text. In a second such configuration, a gettering current source 68 couples a gettering current through deflection electrode stripes 50. It will be recognized that although switching devices 64 are shown as toggle switches, this depiction is merely functional, and that FET's or other transistors are likely to be employed in any practical implementation.

With this arrangement, the first-mentioned configuration is the operational mode, wherein deflector voltage controller 70 provides, in sequence, potentials to deflection electrodes 50 so as to enable a full-color display. The arrangement wherein all deflection electrodes stripes 50 attach at left and right to separate bus structures 60 and 62 accelerates both the charging and discharging of the deflection potentials applied to stripes 50 during display operation.

The second-mentioned configuration is the getter-refresh mode, wherein current flows from supply 88 through deflection electrode stripes 50 via buses 60 and 62 at a predetermined time interval, or in response to a specific event. Since the getter material considered herein, namely ZrVFe, is slightly resistive, stripes 50 will be heated in response to this current flow. This heating of the getter material increases the diffusion rate of the getter oxide into the interior of the material, leaving fresh getter material at the surface, thus reactivating the getter. In order to avoid overheating the getter material, function controller 66 may be configured to enable current to stripes 50 for a getter-refresh mode having an illustrative duration of thirty seconds.

A field emission flat panel display device including a tetrode arrangement, wherein deflection electrodes on the anode plate steer the electrons toward selected regions of an unswitched, high voltage anode electrode, as disclosed herein, and a method of fabricating such structure, as disclosed herein, overcome limitations and disadvantages of the prior art display devices and methods. Hence, for the application to flat panel display devices envisioned herein, the approach in accordance with the present invention provides significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. An anode plate for collecting electrons emitted from a source, said anode plate comprising:

a substrate;

a conductive layer on a surface of said substrate:

deflection electrodes for directing said electrons toward selected regions and away from unselected regions on said conductive layer; and means for coupling potentials selectively to said deflection electrodes, wherein an attracting potential is coupled to deflection electrodes bounding said selected region, and a repelling potential is coupled to deflection electrodes adjacent said unselected regions.

2. The apparatus in accordance with claim 1 wherein said deflection electrodes are formed from an electrically conductive material having gettering qualities.

3. The apparatus in accordance with claim 2 wherein the material of said deflection electrodes comprises zirconium-vanadium-iron.

4. The apparatus in accordance with claim 1 wherein said deflection electrodes comprise a plurality of conductive stripes, said stripes positioned atop electrically insulating barrier structures on said conductive layer.

5. The apparatus in accordance with claim 4 wherein said barrier structures comprise a plurality of substantially parallel, substantially equally-spaced ridges.

6. The apparatus in accordance with claim 5 wherein said conductive stripes are positioned above said conductive layer at a distance which is at least twice the spacing distance between said barrier structures.

7. The apparatus in accordance with claim 4 wherein said barrier structures comprise a spin-on-glass.

8. In an electron emission display apparatus including an emitter structure for emitting electrons and a display panel adjacent said emitter structure responsive to electrons incident thereon, said display panel comprising:

a transparent substrate;

a conductive layer on a surface of said substrate;

luminescent materials overlying regions of said conductive layer;

deflection electrodes for directing said incident electrons toward selected regions and away from unselected regions on said conductive layer; and means for coupling potentials selectively to said deflection electrodes, wherein an attracting potential is coupled to deflection electrodes bounding said selected regions, and a repelling potential is coupled to deflection electrodes adjacent said unselected regions.

9. The display panel in accordance with claim 8 wherein said attracting potential is more positive than said repelling potential.

10. The display panel in accordance with claim 8 wherein said means for coupling potentials selectively to said deflection electrodes comprises means for applying said attracting potential and said repelling potential sequentially to said deflection electrodes.

11. The display panel in accordance with claim 8 wherein said deflection electrodes are formed from an electrically conductive material having gettering qualities.

12. The display panel in accordance with claim 11 wherein the material of said deflection electrodes comprises zirconium-vanadium-iron.

13. The display panel in accordance with claim 8 wherein said conductive layer is transparent.

14. The display panel in accordance with claim 13 wherein said transparent conductive layer comprises indium-tin-oxide (ITO).

15. The display panel in accordance with claim 8 wherein said deflection electrodes comprise a plurality of conductive stripes, said stripes positioned atop electrically insulating barrier structures on said conductive layer.

16. The display panel in accordance with claim 15 wherein said electrically insulating barrier structures are opaque.

17. The display panel in accordance with claim 15 wherein said barrier structures comprise a plurality of substantially parallel, substantially equally-spaced ridges, and said luminescent materials occupy regions on said conductive layer in channels between said barrier structures.

18. The display panel in accordance with claim 17 wherein said regions of said conductive layer between said barrier structures comprise a plurality of substantially parallel, substantially equally-spaced bands, and wherein said luminescent materials occupying said regions comprise, alternately, phosphors luminescing in first, second and third colors.

19. An electron emission display apparatus comprising: an emitter structure including means for emitting electrons; a display panel having a face opposing said emitter structure, said display panel including a transparent substrate, a transparent, electrically conductive layer on a surface of said substrate, luminescent materials overlying regions of said transparent, electrically conductive layer, and deflection electrodes responsive to potentials applied thereto for deflecting said incident electrons, said deflection electrodes comprising a plurality of conductive stripes positioned atop electrically insulating barrier structures on said conductive layer; and source means tier applying potentials to said emitter structure, said display panel conductive layer, and selectively to said deflection electrodes to accelerate electrons emitted by said emitting means toward selected ones of said regions of said display panel conductive layer and to repel electrons emitted by said emitting means away from unselected ones of said regions of said display panel conductive layer.

20. The display apparatus in accordance with claim 19 wherein said electrically insulating barrier structures are opaque.

21. The display apparatus in accordance with claim 19 wherein said deflection electrodes are formed from an electrically conductive material having gettering qualities.

22. The display apparatus in accordance with claim 21 wherein the material of said deflection electrodes comprises zirconium-vanadium-iron.

23. The display apparatus in accordance with claim 19 wherein said barrier structures form a plurality of substantially parallel, substantially equally-spaced ridges, and said luminescent materials occupy regions on said transparent, electrically conductive layer in channels between said barrier structures.

24. The display apparatus in accordance with claim 23 wherein said regions of said transparent, electrically conductive layer between said barrier structures comprise a plurality of substantially parallel, substantially equally-spaced bands, and wherein said luminescent materials occupying said regions comprise, alternately, phosphors luminescing in first, second and third colors.

25. The display apparatus in accordance with claim 24 wherein said source means for applying potentials selectively to said deflection electrodes comprises means for applying an attracting potential to deflection electrodes bounding selected regions; and means for applying a repelling potential, more negative than said attracting potential, to a deflection electrode adjacent unselected regions.

26. The display apparatus in accordance with claim 25 wherein said source means for applying potentials selectively to said deflection electrodes comprises means for applying said attracting potential and said repelling potential sequentially to said deflection electrodes.

27. A method of operating a field emission display comprising an emitter structure including means for emitting electrons; a display panel having a face opposing said emitter structure, said display panel including a transparent substrate, a conductive layer on a surface of said substrate, luminescent materials overlying regions of said conductive layer, and deflection electrodes adjacent said regions overlain by said luminescent materials and responsive to potentials applied thereto tier deflecting said incident electrons; and source means for applying potentials to said emitter structure, said display panel conductive layer, and selectively to said deflection electrodes to steer electrons emitted by said emitting means toward selected regions of said display panel conductive layer; said operating method comprising:

attracting electrons toward selected regions of said conductive layer overlain by said luminescent materials by applying an attracting potential to deflection electrodes adjacent each of said selected regions; while repelling electrons from other regions of said conductive layer overlain by said luminescent materials by applying a repelling potential, more negative than said attracting potential, to a deflection electrode adjacent each of said other regions.

28. The method in accordance with claim 27 wherein said attracting and repelling steps are repeated sequentially for the totality of said regions of said conductive layer.

* * * * *